US008070149B2

(12) United States Patent
Schober et al.

(10) Patent No.: US 8,070,149 B2
(45) Date of Patent: Dec. 6, 2011

(54) ARRANGEMENT FOR GATHERING OR ASSEMBLING PRINTED SHEETS FOR PRODUCING BOUND PRINTED PRODUCTS

(75) Inventors: Thomas Schober, Ermatingen Tg (CH); Erich Jornot, Seuzach Zh (CH)

(73) Assignee: Mueller Martini Holding AG, Hergiswil (CH)

( * ) Notice: Subject to any disclaimer, the term of this patent is extended or adjusted under 35 U.S.C. 154(b) by 225 days.

(21) Appl. No.: 12/405,627

(22) Filed: Mar. 17, 2009

(65) Prior Publication Data

US 2009/0234492 A1 Sep. 17, 2009

(30) Foreign Application Priority Data

Mar. 17, 2008 (EP) ..... 08405078

(51) Int. Cl.
*B65H 39/00* (2006.01)
*B65H 39/04* (2006.01)

(52) U.S. Cl. ..... 270/52.21; 270/52.14; 270/52.16; 270/52.19; 270/52.2; 270/52.22

(58) Field of Classification Search ..... 270/52.14, 270/52.16, 52.19, 52.2, 52.21, 52.22, 52.26, 270/52.29
See application file for complete search history.

(56) References Cited

U.S. PATENT DOCUMENTS 4,177,979 A * 12/1979 Orsinger et al. ..... 270/52.16
4,729,683 A * 3/1988 Staniszewski ..... 400/624
5,082,256 A * 1/1992 Bryson ..... 270/52.2
5,164,906 A 11/1992 Mahmoodi et al.
6,916,018 B2 * 7/2005 Graushar et al. ..... 270/4
7,571,903 B2 * 8/2009 Desfosses et al. ..... 270/52.2

FOREIGN PATENT DOCUMENTS

DE 36 12 559 A1 10/1987
DE 10 2005 020591 B3 1/2007
EP 1 285 872 A1 2/2003

OTHER PUBLICATIONS

European Search Report dated Oct. 16, 2008 issued in Priority Application No. EP 08405078.0.

* cited by examiner

*Primary Examiner* — Leslie A Nicholson, III
(74) *Attorney, Agent, or Firm* — Venable LLP; Robert Kinberg; Christopher Ma

(57) ABSTRACT

An arrangement for gathering or assembling printed sheets into semi-finished products for producing bound printed products, the arrangement including a conveying device and a plurality of replaceable feeder units arranged side-by-side along the conveying device. Each replaceable feeder unit includes at least two feeders for supplying the printed sheets to the conveying device and an undercarriage. The plurality of replaceable feeder units are arranged on the undercarriage. The undercarriage includes interface sections assigned, respectively, to the replaceable feeder units and the interface sections each include a first interface configuration. The arrangement further includes an adapter device that is arranged on the interface section and includes a top side compatible for attaching feeders with a second interface configuration different from the first interface configuration and includes a bottom side compatible with the first interface configuration so that the adapter device can be fitted on the interface section of the undercarriage.

8 Claims, 6 Drawing Sheets

ARRANGEMENT FOR GATHERING OR ASSEMBLING PRINTED SHEETS FOR PRODUCING BOUND PRINTED PRODUCTS

CROSS-REFERENCE TO RELATED APPLICATION

This application claims priority to European Patent Application No. 08405078.0, filed on Mar. 17, 2008, the subject matter of which is incorporated herein by reference.

BACKGROUND OF THE INVENTION

The invention relates to an arrangement for gathering or assembling printed sheets into semi-finished products for producing bound printed products. The arrangement has several side-by-side arranged replaceable feeder units positioned along a conveying device. The individual feeder units include at least two feeders for supplying printed sheets to the conveying device and the conveying device includes pushers. Each feeder unit can be fitted onto an undercarriage and each feeder unit is assigned an interface section for controlling the operation and for supplying available power.

Arrangements of the aforementioned type are known to one skilled in the art in the form of gathering machines for perfect binders or assembling devices and/or gathering conveyors for gathering and wire-stitching machines. These arrangements are provided with a plurality of feeders arranged along the gathering arrangement, which supply the conveying device with printed products. Even though the principles for supplying these feeding devices are similar, there are certain differences with respect to design and embodiment. These differences at least include the desire for a highly economic operation depending on the size of the edition to be processed, as well as depending on the complexity of the printed products or the printed sheets to be processed and/or on the finished products.

Complex printing products may include, for example, several printed sheets, glued-in cards and/or goods samples, sheets to be bound in at the open side, or sheets with a final fold at the top. All printed sheets or signatures, which deviate from standard and/or easy to process format, require specifically designed feeders for the processing. The position of such feeders along the conveying device is furthermore also determined by the type of embodiment used and the predetermined form and/or the content of the printed products to be produced. For technical reasons in the area of manufacturing, transport, and assembly, the undercarriage may include several strung-together undercarriage segments.

Owing to the high expenditure for an arrangement of this type, one object of the invention is to provide a more economic use for the known arrangement that includes several elements. Gathering machines for the processing of standard-type printed sheets or signatures are known. The gathering machines include identical machine elements, strung-together as seen in conveying direction, wherein each machine element forms a unit that cannot be further divided. With this type of design, a uniform infrastructure is provided for the machine elements, for example for the feeder drive, the separating elements, or the holding back devices.

Two different types of structural designs are generally known for these gathering machines: Type I machines and Type II machines. First, Type I machines are machines that operate at a low production speed for processing standard printed sheets, which function as simple gathering machines without flexibility. Second, Type II machines include machines operating at a higher production speed and optionally include different feeders, and have a higher degree of flexibility. Client needs require the market to provide additional gathering machines which have a certain amount of flexibility, without simultaneously requiring a high production output.

SUMMARY

An object of the invention is to create an arrangement for gathering or assembling printed sheets, which on the one hand has a simple design and, on the other hand, offers the option of processing printed sheets that differ from the standard type of printed sheets.

The above and other objects are accomplished according to one aspect of the invention, wherein there is provided: an arrangement for gathering or assembling printed sheets into semi-finished products for producing bound printed products, the arrangement comprising: a conveying device including a pusher to push the printed sheets in a conveying direction; a plurality of replaceable feeder units arranged side-by-side along the conveying device, each replaceable feeder unit including at least two feeders for supplying the printed sheets to the conveying device; an undercarriage, wherein the plurality of replaceable feeder units are arranged on the undercarriage, wherein the undercarriage includes interface sections assigned, respectively, to the replaceable feeder units, wherein the interface sections each include a first interface configuration to control operation of and to supply power to the assigned replaceable feeder units; and an adapter device arranged on the interface section and including a top side and a bottom side, the top side compatible for attaching feeders with a second interface configuration different from the first interface configuration and the bottom side compatible with the first interface configuration so that the adapter device can be fitted on the interface section of the undercarriage.

According one aspect of the invention, the undercarriage may be embodied such that an adapter device can be fitted on in the interface section, which adapter device is embodied on the underside to be compatible with the undercarriage and is embodied on the top for attaching feeders in an arrangement that differs from the interface arrangement.

BRIEF DESCRIPTION OF THE DRAWINGS

The present invention will be more readily understood from the following detailed description when read in conjunction with the accompanying drawing, in which.

DETAILED DESCRIPTION

Figure 1:
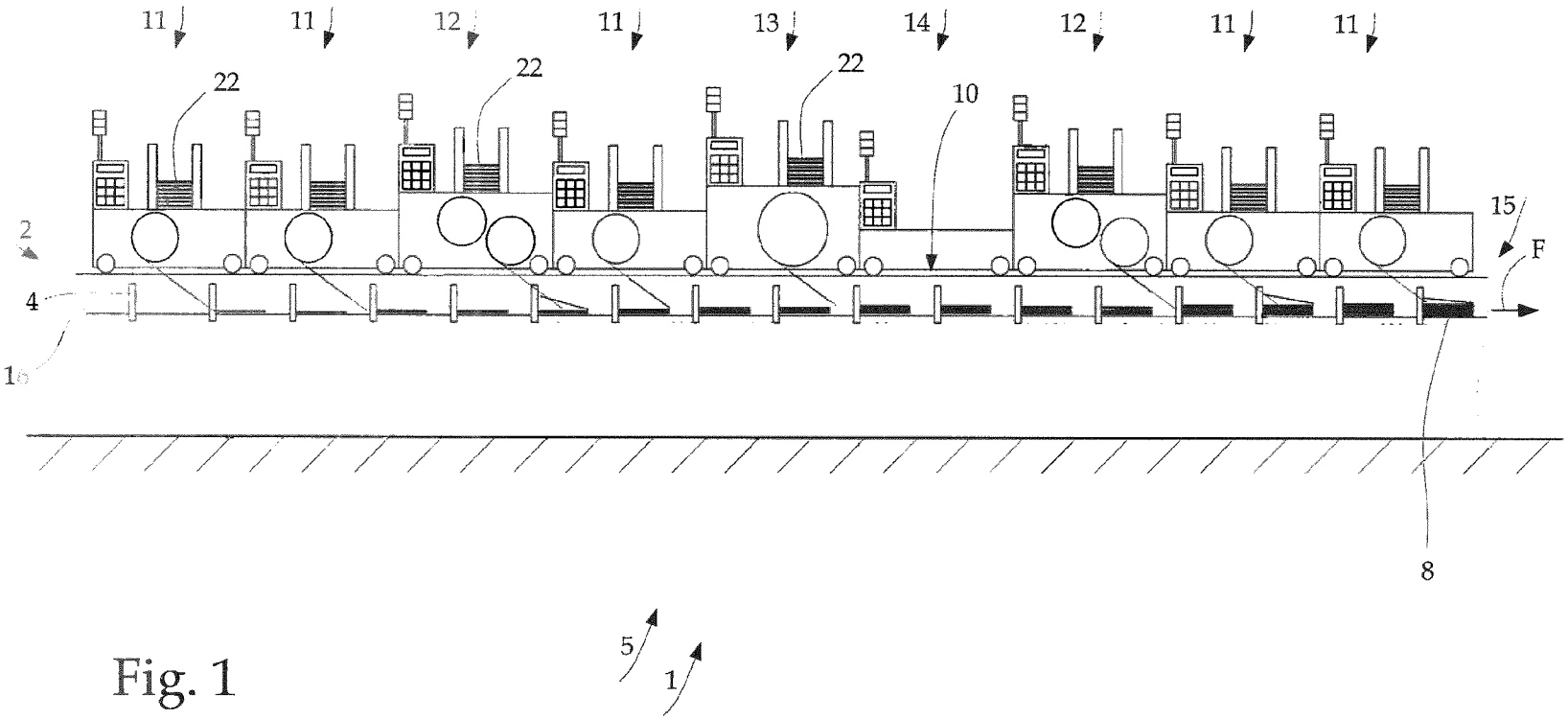
FIG. 1 is a schematic representation of a Type I gathering device according to the prior art, which is provided with different feeders.

FIG. 1 illustrates a detail of a Type I complex gathering device 1 according to the prior art, which is designed for assembling printed sheets 22 into semi-finished products 8 for producing bound printed products such as books, brochures and the like. The gathering device 1 has a modular configuration and includes undercarriage segments of the Type I gathering device, strung together in conveying direction F. Different feeders 11, 12, 13, 14 which are suitable for use with the Type I gathering device are arranged on the undercarriage segments.

Figure 2:
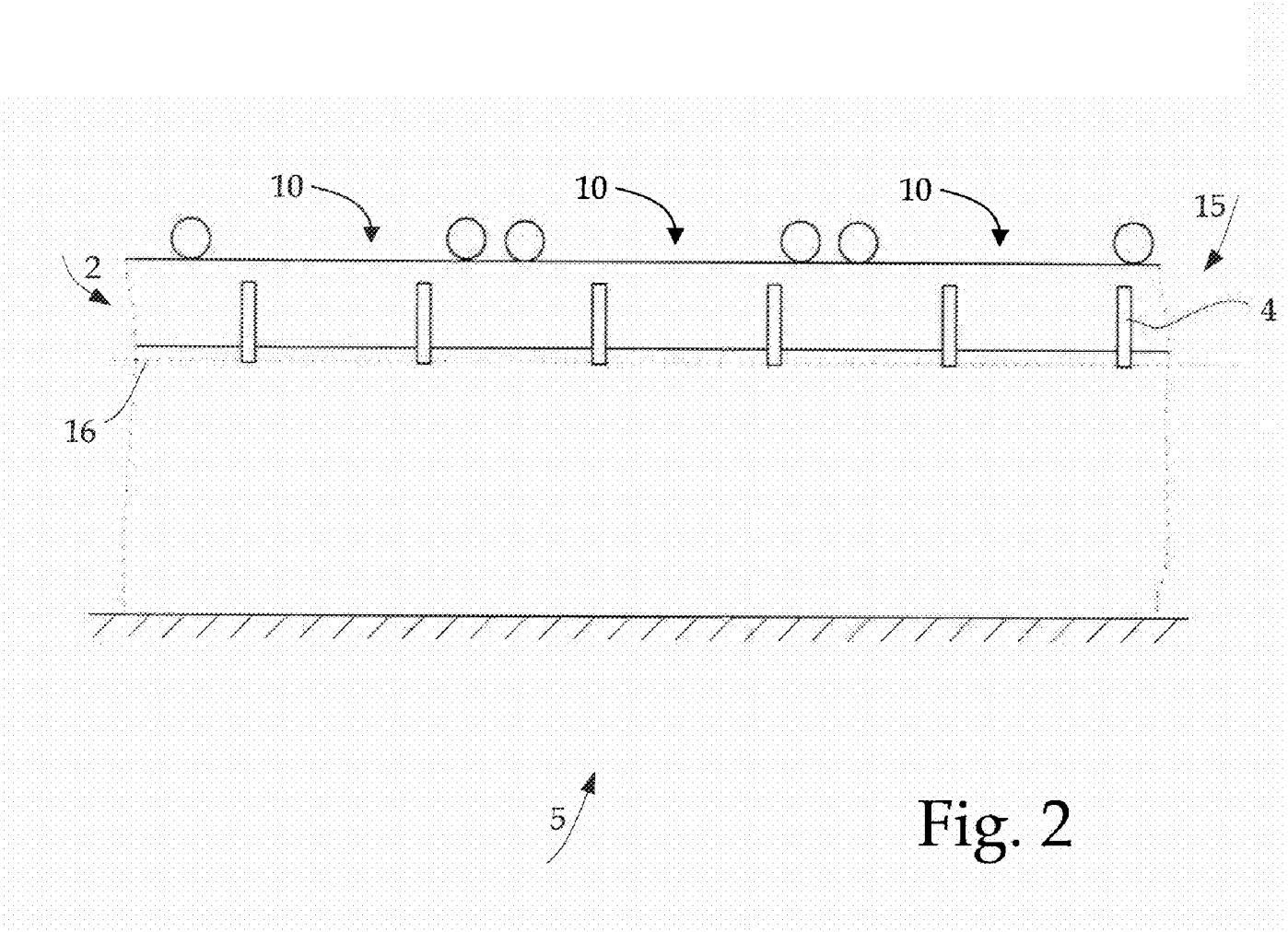
FIG. 2 is an undercarriage segment for the gathering device according to FIG. 1.
Figures 3, 4, 5, 6:
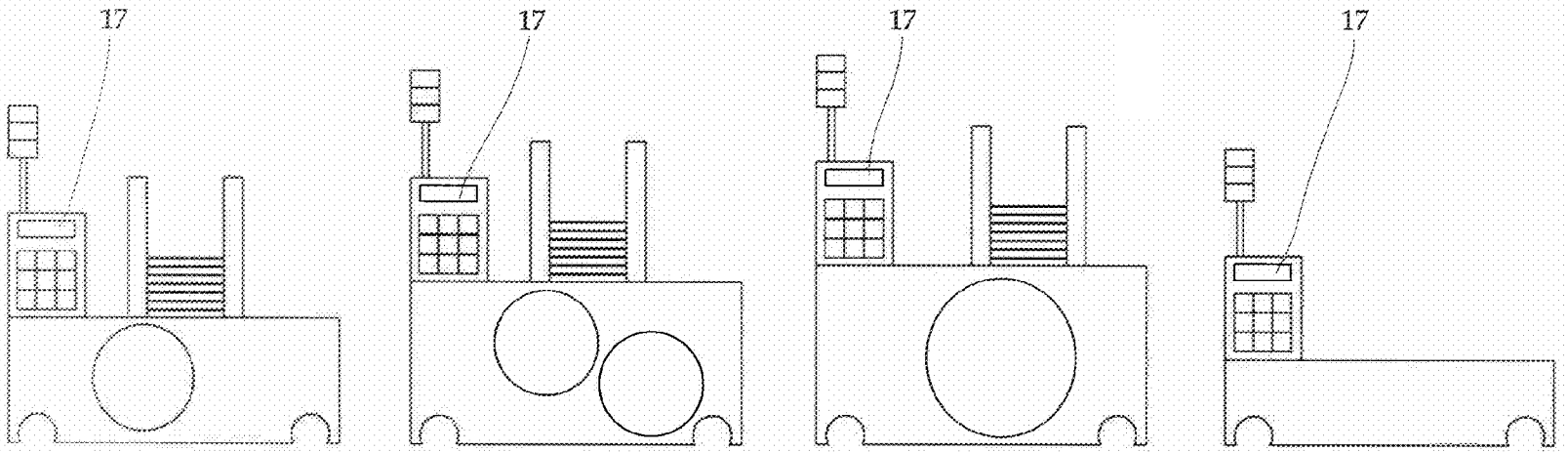
FIG. 3 is a standard feeder for printed sheets, for the gathering device shown in FIG. 1.
FIG. 4 is a special feeder for the gathering device according to FIG. 1.
FIG. 5 is an alternative special feeder for the gathering device according to FIG. 1.
FIG. 6 is a different special feeder for the gathering device according to FIG. 1.

FIG. 2 shows the undercarriage segments and/or the undercarriage which include a plurality of identical feeder interfaces 10 for the feeders 11, 12, 13, 14. The feeders 11, 12, 13, 14 are suitable for use with the Type I gathering device, as well as a section of the conveying device 2 that corresponds to the total length of these segments. The Figures show different feeders: FIG. 3 shows a standard feeder 11, FIG. 4 shows a special feeder 12, FIG. 5 shows an alternative special feeder 13, and FIG. 6 shows a different special feeder 14. The feeders 11, 12, 13, 14 differ in that each is embodied to handle the separating and feeding of a specific type of printed sheet 22. The undersides of all the feeders 11, 12, 13, 14 are embodied so as to match the feeder interfaces (interface configurations) 10 on the undercarriage segments.

Figure 11:
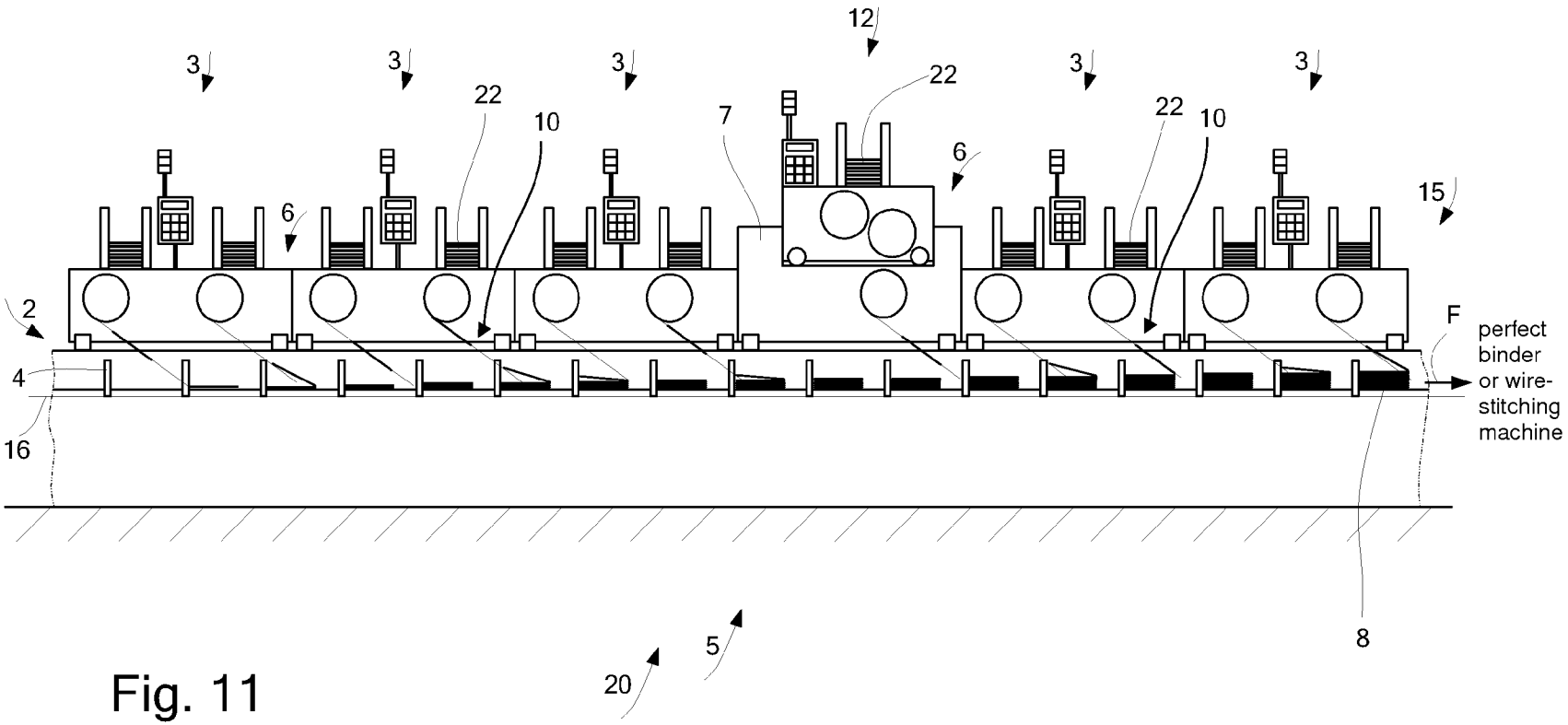
FIG. 11 is the gathering device according to FIG. 7 with a special feeder that is connected to the adapter device.

The undercarriage segment shown in FIG. 2, for example, includes three feeder interfaces 10, wherein these feeder interfaces 10 are shown simplified in FIGS. 1, 2 and 11. The feeder interfaces 10 include the complete infrastructure required for operating the individual feeders 11, 12, 13, 14. Example of such infrastructures include the connections for the energy supply, the lines for replacing the control signals, as well as those for supplying compressed air, vacuum and lubricants. The Type I gathering device 1 is designed to be fully flexible. By stringing together undercarriage segments, it is possible to configure an optionally long conveying device 2 having an optional number of feeder interfaces 10. As a result of the replacement option for the feeders 11, 12, 13, 14, it is possible to select the sequence in which the semi-finished products 8 are gathered.

Figure 7:
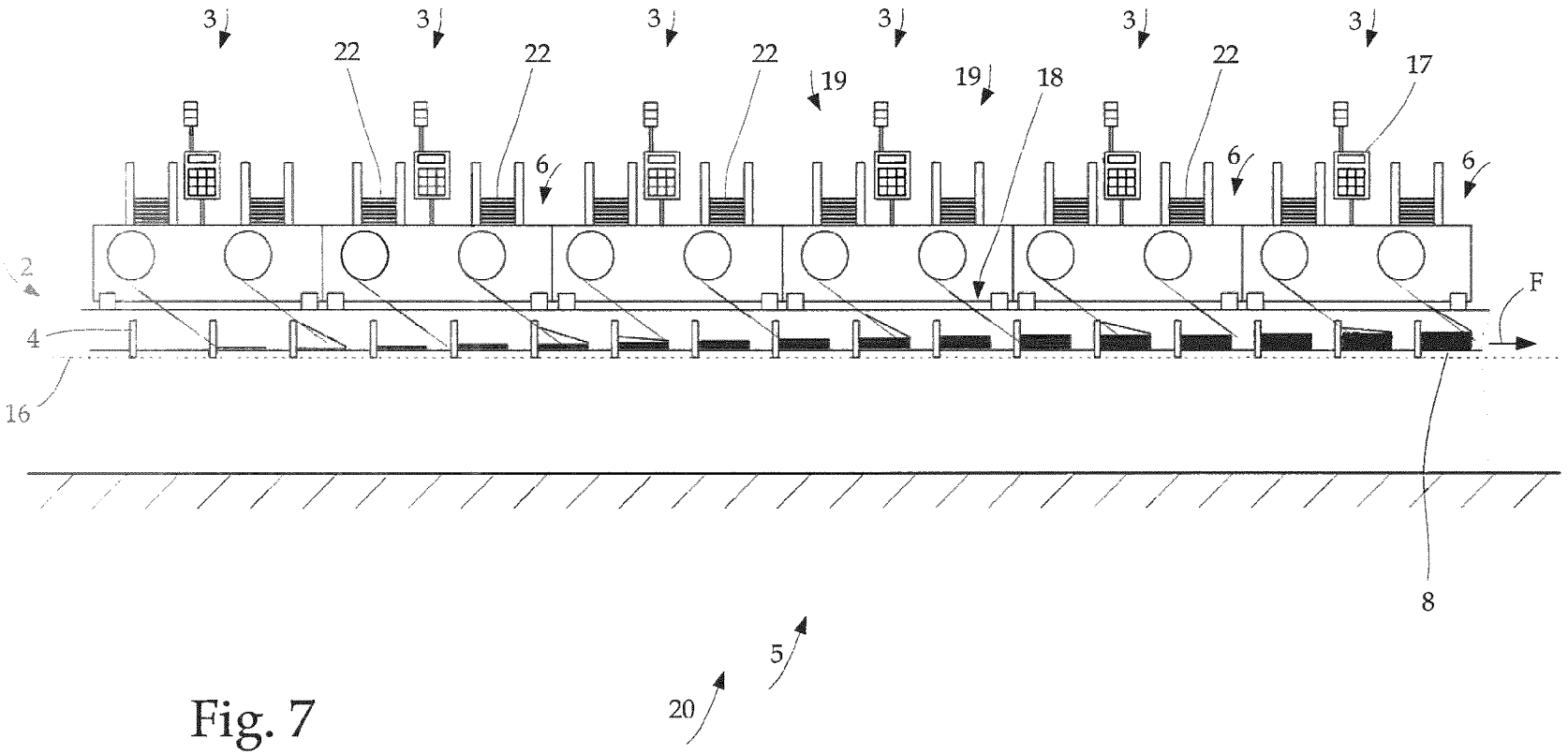
FIG. 7 is a schematic representation of a simple Type II gathering device according to the prior art, which is equipped with identical feeder units.
Figure 9:
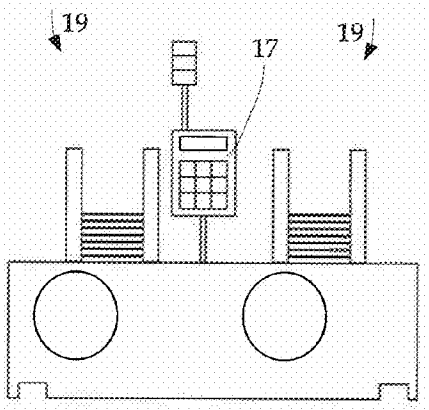
FIG. 9 is a feeder unit for the Type II gathering device shown in FIG. 7.
Figure 10:
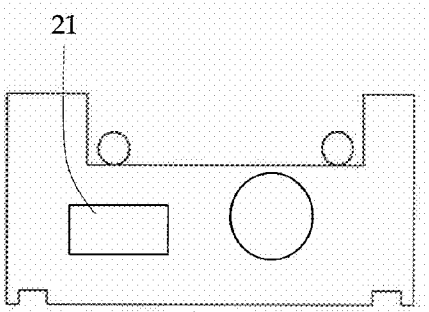
FIG. 10 is an adapter device for a gathering device according to the invention.
Figure 8:
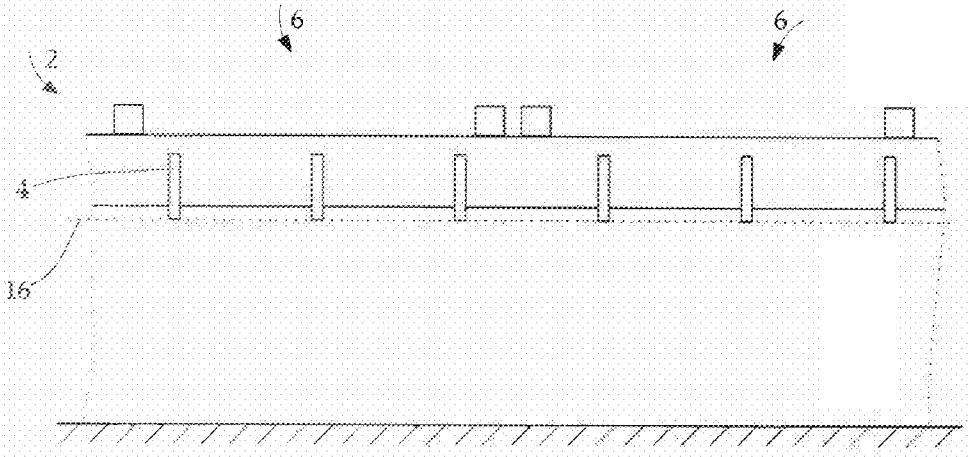
FIG. 8 is an undercarriage segment for the Type II gathering device according to FIG. 7.

FIG. 7 illustrates a Type II gathering device 20 for assembling or gathering printed sheets 22 into semi-finished products 8 for producing bound printed products. This gathering device includes a plurality of replaceable feeder units 3, arranged side-by-side along a conveying device 2, for supplying printed sheets 22. The printed sheets are supplied to a conveying device 2 that has pushers 4. Each of the feeder units 3 that is fitted onto an undercarriage 5. Each of the feeder units is coordinated with an interface section 6, which is designed for the control and the supply of energy. Each undercarriage 5 includes an interface configuration 18 for the respective interface section 6, as well as a section of the conveying device 2 that coincides with its length.

The conveying device 2 is arranged on the undercarriage 5. The conveying device 2 is substantially formed by a channel 15 with pushers 4 that are attached to a circulating traction means 16. The pushers 4 push the printed sheets 22 in conveying direction F through the channel 15 during the gathering operation. The feeder units 3, arranged above the conveying device 2, transport the printed sheets 22 in approximately the same conveying direction F. A feeder unit 3 comprises several feeders 19, an operating mechanism 17, and an interface configuration 18 that is formed by two adjoining segments. As a result, there is no need to have a complete infrastructure for each individual feeder 19. The infrastructure present in the feeder unit 3 may be used jointly by several feeders 19 when using the first interface configuration 18 and the operating mechanism 17. With synchronously operating feeders 19, a single drive can jointly operate the suctioning devices, the grippers, and the hold-back devices for a single feeder unit 3.

FIG. 11 again shows the Type II gathering device 20 according to FIG. 7, with the difference that in place of a feeder unit 3, there is an adapter device 7 that attaches a special feeder 12 of the Type I gathering device 1, shown in FIG. 1, to the undercarriage. The adapter device 7 is provided on its underside with an interface that is compatible with the interface configuration 18. The top of the adapter device 7 may attach the feeders 11, 12, 13, 14 that have a configuration that differs from the configuration for the interface configuration 18. The interface configuration 18 may have a device for aligning and attaching feeder units 3 or adapter devices 7, with connections for supplying and discharging air or lubricants, and with connections for supplying power as well as changing the control signals. The top side of adapter device 7 may include the same type of feeder interface or interface configuration 10 as the undercarriage segments for the Type I gathering device 1 and may have the same approximate length as an interface section 6. The adapter device 7 for another preferred embodiment may be designed to function as a conveying element for transporting the printed sheets 22 between the feeders 11, 12, 13, 14 and the conveying device 2 and may be provided with a device for driving these feeders.

A control unit 21, installed between the two interfaces of the adapter device 7, may control the adapter device 7 and may change the control signals for the feeders 11, 12, 13, 14 and the interface 18 of the undercarriage 5. In other words, the control unit 21 of the adapter device 7 may act toward a feeder 11, 12, 13, 14 of the Type I machine as if the latter were mounted on an undercarriage of a Type I gathering device 1 and the adapter device 7 may act toward the undercarriage 5 of a Type II machine as if a feeder unit 3 of the Type II gathering device 20 were affixed. Thus, the use of this adapter device 7 makes it possible to take an optional feeder 11, 12, 13, 14 of the Type I gathering device 1 and integrate it into a Type II gathering device 20.

It will be understood that the above description of the present invention is susceptible to various modifications, changes and adaptations, and the same are intended to be comprehended within the meaning and range of equivalents of the appended claims.

What is claimed is:

1. An arrangement for gathering or assembling printed sheets into semi-finished products for producing bound printed products, the arrangement comprising:

a conveying device including a plurality of pushers to push the printed sheets in a conveying direction;

a plurality of replaceable feeder units arranged side-by-side along the conveying device, each replaceable feeder unit including at least two feeders for supplying the printed sheets to the conveying device, an undercarriage, wherein the plurality of replaceable feeder units are arranged on the undercarriage, wherein the undercarriage includes interface sections assigned, respectively, to the replaceable feeder units, wherein the interface sections each include a first interface configuration to control operation of and to supply power to the assigned replaceable feeder units; and an adapter device, the adapter device arrangeable on the interface section and including a top side and a bottom side, the top side compatible for attaching feeders with a second interface configuration different from the first interface configuration and the bottom side compatible with the first interface configuration so that the adapter device can be fitted on the interface section of the undercarriage.

2. The arrangement according to claim 1, wherein the replaceable feeder units are arranged above the conveying device on the undercarriage, and wherein the replaceable feeder units include a plurality of feeders to transport the printed sheets in approximately the same conveying direction as the conveying device.

3. The arrangement according to claim 1, wherein the adapter device has a length that is approximately the same length as one of the interface sections.

4. The arrangement according to claim 1, wherein the adapter device comprises a conveying element to transfer the printed sheets from the feeders to the conveying device and the adapter device is installed between the feeders and the conveying device.

5. The arrangement according claim 1, wherein the adapter device includes different interfaces on the bottom side and on the top side.

6. The arrangement according to claim 1, wherein the undercarriage comprises a plurality of segments, wherein the plurality of segments coincides with a length of the replaceable feeder units.

7. A method of producing bound printed products, comprising:

utilizing the arrangement of claim 1; and installing the undercarriage upstream of a perfect binder.

8. A method of producing bound printed products, comprising:

utilizing the arrangement of claim 1; and installing the undercarriage upstream of a wire-stitching machine.

* * * * *